US005980023A

United States Patent [19]

Kitamura

[11] Patent Number: 5,980,023

[45] Date of Patent: Nov. 9, 1999

[54] RECORDING ELECTRODE WITH IMPROVED BASE FILM FOR HIGH QUALITY IMAGE RECORDING

[75] Inventor: Tetsuya Kitamura, Gifu, Japan

[73] Assignee: Brother Kogyo Kabushiki Kaisha, Nagoya, Japan

[21] Appl. No.: 08/709,272

[22] Filed: Sep. 6, 1996

[30] Foreign Application Priority Data

Sep. 6, 1995 [JP] Japan ..... 7-229094

[51] Int. Cl.[6] ..... B41J 2/06

[52] U.S. Cl. ..... 347/55

[58] Field of Search ..... 347/55, 112, 141, 347/151

[56] References Cited

U.S. PATENT DOCUMENTS 5,036,341 7/1991 Larsson ..... 347/55

FOREIGN PATENT DOCUMENTS

A1-0 587 366 3/1994 European Pat. Off. ..... B41J 2/06
1-503221 11/1989 Japan ..... B41J 2/06
A-6-255163 9/1994 Japan ..... B41J 2/06

OTHER PUBLICATIONS

Patents Abstracts of Japan, vol. 96, No. 12, JP–A–8–324017 (Brother Ind Ltd) Jun. 6, 1995.

"Asahi Chemical Synthesizes PPTA Aramide Amorphous Films", *Asahi Chemical Industry News*, Apr. 15, 1991.

Patents Abstracts of Japan, vol. 18, No. 662, JP–A2–06256960 (Sumitomo Metal Mining Co.) Sep. 13, 1994.

*Primary Examiner*—Benjamin R. Fuller
*Assistant Examiner*—C. Dickens
*Attorney, Agent, or Firm*—Oliff & Berridge, PLC

[57] ABSTRACT

To provide a recording apparatus that is capable of recording high quality images free from density unevenness, a recording electrode used in the recording apparatus is formed from an electrically insulating base film formed with a plurality of apertures, and control electrodes formed on the front surface of the base film to surround each of the plurality of apertures. To obtain the base film which is not likely to be scratched or wrinkled, a product of the modulus of elasticity of the base film and the thickness thereof to the third power needs to be more than 0.008 kg·mm.

19 Claims, 5 Drawing Sheets

RECORDING ELECTRODE WITH IMPROVED BASE FILM FOR HIGH QUALITY IMAGE RECORDING

BACKGROUND OF THE INVENTION

1. Field of the Invention

The present invention relates to a recording electrode used in recording apparatuses such as a facsimile machine or a printer.

2. Description of the Related Art

There have been known recording apparatuses of the type in which a recording electrode is used. One type of the recording electrode is made up of an electrically insulating base film formed with apertures therein, and a control electrode formed on the surface of the base film to surround the apertures. A high molecular compound, such as polyester or polyimide, is used for the base film. The apertures are formed by excimer laser. The control electrode is formed from metals such as copper or aluminum.

The recording apparatus using such a recording electrode includes a toner charging means for charging toner particles, a toner-bearing drum for bearing and conveying the charged toner particles, a control voltage applying circuit for applying a voltage to the control electrode of the recording electrode, and a back electrode disposed to confront the toner-bearing drum with a small spacing formed therebetween. The recording electrode is held so that the rear surface thereof faces the toner-bearing drum and the portion around the apertures is in contact with the toner-bearing drum. Frictional resistive force is imparted on the toner particles deposited on the surface of the toner-bearing drum in the direction opposite the toner conveying direction. Shearing force resulting from the frictional resistive force and attraction force by the toner-bearing drum is imparted on the toner particles. The shearing force quivers the toner particles on the toner-bearing drum. The frictional resistive force is proportional to the contacting pressure between the recording electrode and the toner-bearing drum.

The quivering toner particles are free from attraction force for attracting the toner particles to the toner-bearing drum, such as image force or Van der Waals force. Coulomb force is generated by the electric field that is developed inside the apertures by the voltage applied to the control electrode. This Coulomb force is imparted on the toner particles free from the attraction force. The Coulomb force controls the passage of the charged toner particles through the apertures. The toner particles which have passed through the apertures are attracted by the back electrode and thus captured by a recording medium introduced into the spacing between the back electrode and the toner-bearing drum. In this manner, an image is formed on the recording medium in accordance with the voltage applied to the control electrode.

A problem with the above-described recording apparatus is that the density of an image formed on the recording medium is locally uneven.

SUMMARY OF THE INVENTION

The present invention has been made to solve the above-described problem, and accordingly it is an object of the present invention to provide a recording electrode capable of recording high quality images free from density unevenness.

To achieve the above and other objects, there is provided a recording electrode that includes a base film made from an electrically insulating material, and a control portion for selectively producing an electric field that attracts charged toner particles, wherein a product of a modulus of elasticity of the base film and the thickness of the base film to the third power is more than 0.008 kg·mm.

The control portion of the recording electrode comprises a plurality of control electrodes formed on the base film to surround respective one of a plurality of apertures formed in the base film.

The control portion of the recording electrode may comprise mesh-pattern electrodes or a plurality of edge electrodes having edge portions.

According to another aspect of the invention, there is provided a recording electrode that includes a base film formed with a plurality of apertures, and control electrodes formed on the base film to surround respective ones of the plurality of apertures, wherein a product of the modulus of elasticity of the base film and the thickness of the base film to the third power is more than 0.008 kg·mm. Preferably, the product of the modulus of elasticity and the thickness to the third power is more than 0.014 kg·mm.

In one example, the modulus of elasticity of the base film is more than 512 kg/m$^2$ and the thickness of the base film is 25 $\mu$m. The control electrode has a 8 $\mu$m thickness. It is desirable that the base film be made from a high molecular resin, such as polyimide or aromatic polyamide.

According to still another aspect of the present invention, there is provided a recording apparatus for recording images on a recording medium using the above-described recording electrode. The apparatus includes toner supplying means for supplying charged toner particles, a back electrode, and the above-described recording electrode, wherein electric field capable of attracting charged toner particles is produced by applying a voltage to the back electrode. The recording electrode is disposed between the toner supplying means and the back electrode and within the electric field produced by applying the voltage to the back electrode. The recording electrode has a control portion for selectively producing an electric field that attracts the toner particles supplied by the toner supply means, thereby producing a flow of toner particles from the toner supply means toward the back electrode.

Bending rigidity of the base film is generally represented by the following equation:

$$D=Et^3/12(1-\nu^2)$$

where D is the bending rigidity, E a modulus of elasticity, t the thickness of the base film, and $\nu$ is Poisson's ratio. From the above equation, it can be appreciated that the rigidity of the base film increase if the product of the modulus of elasticity of the base film and the thickness of the base film to the third power is large, whereby scratches or wrinkles are not easily produced in the base film.

BRIEF DESCRIPTION OF THE DRAWINGS

The particular features and advantages of the invention as well as other objects will become more apparent from the following description taken in connection with the accompanying drawings, in which.

DETAILED DESCRIPTION OF THE PREFERRED EMBODIMENTS

A preferred embodiment of the present invention will be described with reference to the accompanying drawings.

Figure 1:
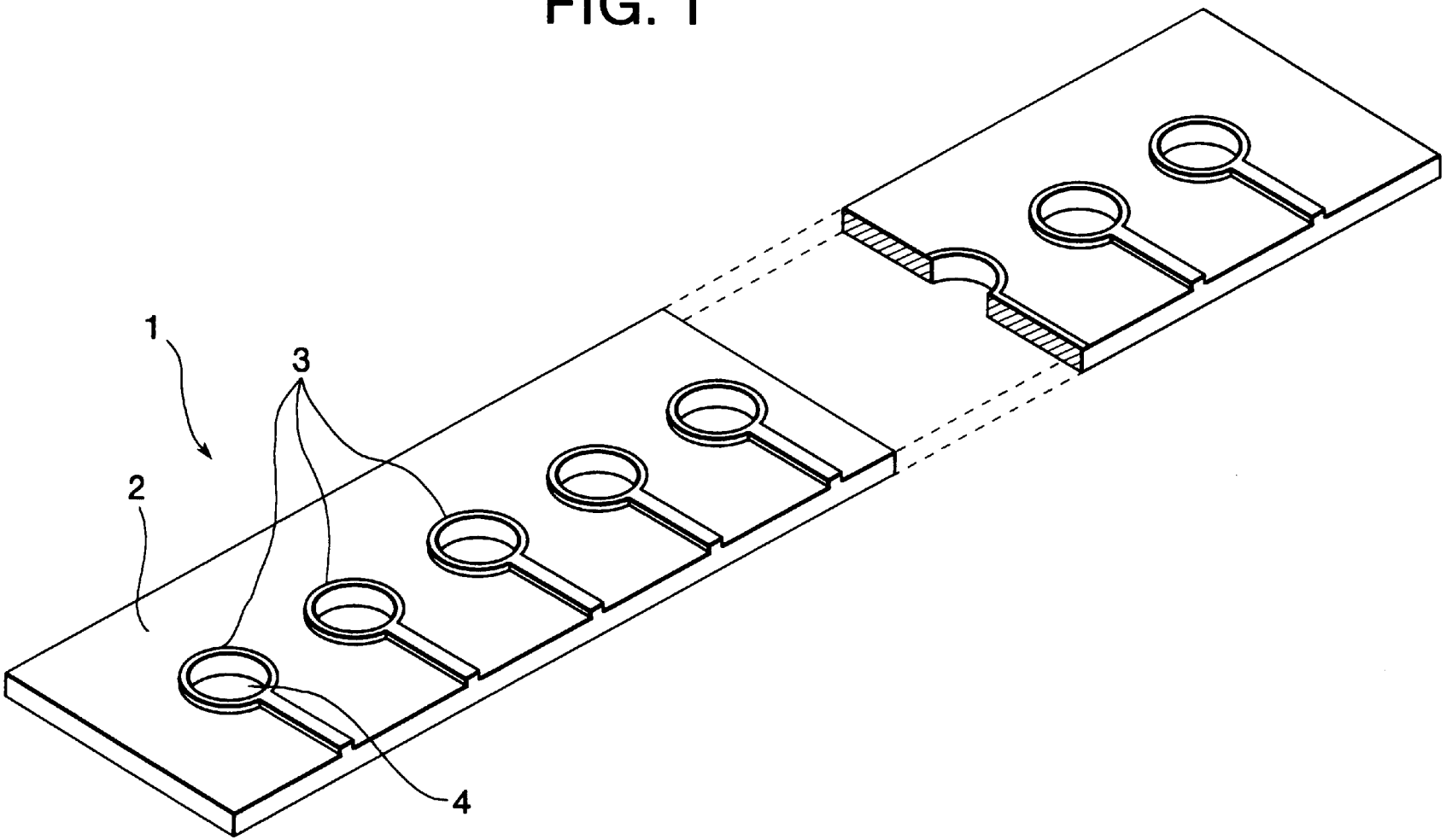
FIG. 1 is a perspective view showing an aperture electrode according to an embodiment of the present invention.

FIG. 1 shows an aperture electrode used as a recording electrode. The aperture electrode 1 has a base film 2 formed from an electrically insulating material to be described later. A multiplicity of apertures 4 are formed in the base film 2. The apertures 4 are aligned at an equi-interval in the longitudinal direction of the base film 2. A multiplicity of control electrodes 3 are formed on the upper surface of the base film 2 to individually surround the respective ones of the apertures 4. The base film 2 is made from a high molecular resin film having more than 512 kg/mm$^2$ in modulus of tensile elasticity and 25 $\mu$m in thickness, preferably polyimide. The control electrode 3 is made from a metal film having 8 $\mu$m thickness, preferably copper film. The respective control electrodes 3 are connected to a control voltage applying circuit 5. The aperture 4 is a through-hole having an inner diameter of approximately 80 $\mu$m.

Examples of high molecular resin films having more than 512 kg/mm$^2$ modulus of tensile elasticity and 25 $\mu$m thickness are polyimide film known as UPILEXS™ (900 kg/m$^2$ modulus of tensile elasticity) produced by Ube Industries, Ltd. and aromatic polyamide film known as ARAMICA™ (1500 kg/m$^2$ in modulus of tensile elasticity) produced by Asahi Chemical Industry Co., Ltd.

Figure 2:
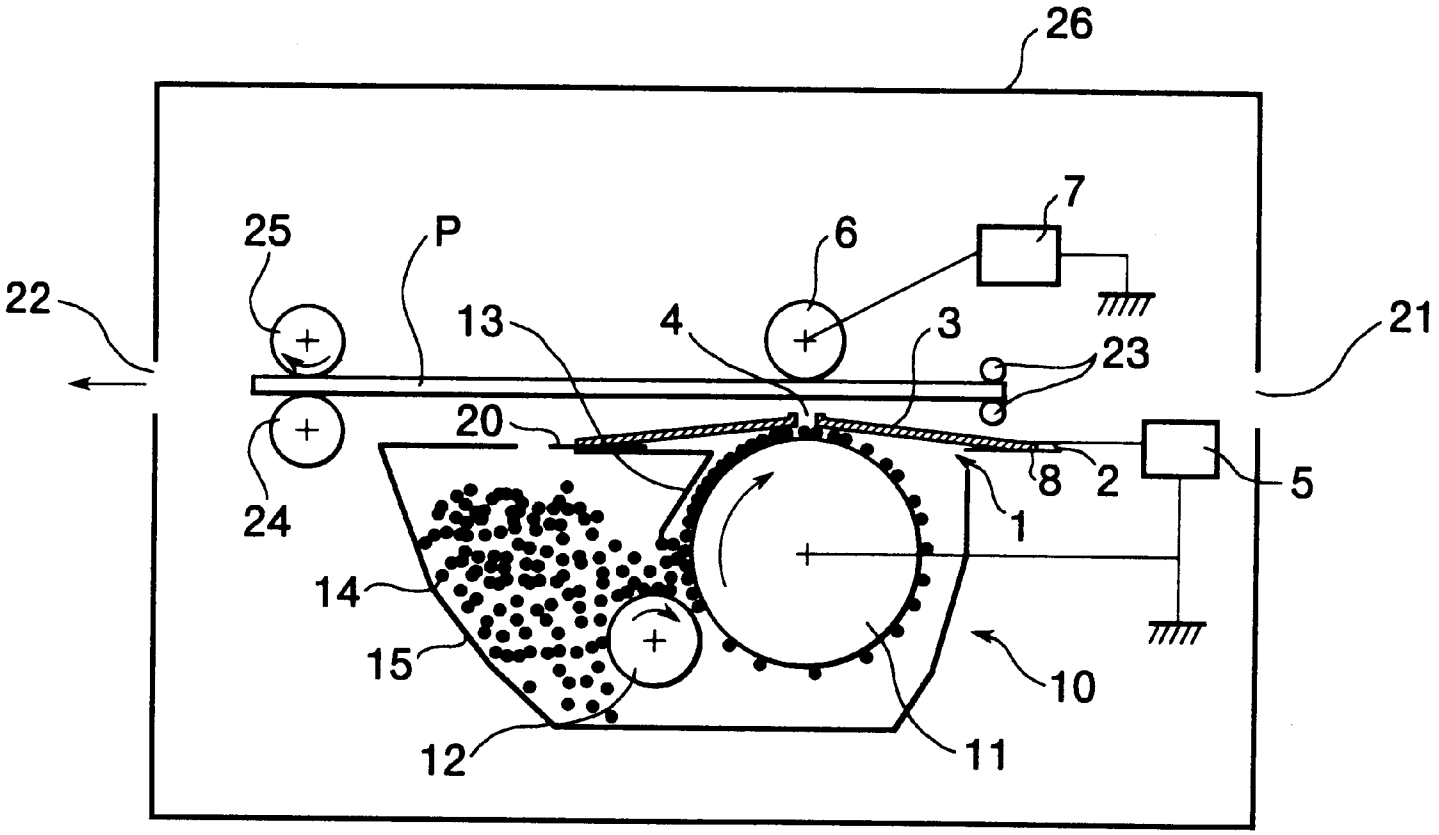
FIG. 2 is a schematic cross-sectional view showing a recording apparatus incorporating the aperture electrode shown in FIG. 1.

Next, a recording apparatus incorporating the aperture electrode 1 will be described while referring to FIGS. 2 and 3. FIG. 2 shows such a recording apparatus. In the right side portion of a housing 26 is formed an insertion opening 21 for inserting a recording medium P. In the left side portion of the housing 26 is formed a discharge port 22 from which the image bearing recording medium P is discharged. The aperture electrode 1, a back electrode 6, and a toner charge/supply unit 10 are provided interiorly of the housing 26.

The aperture electrode 1 is supported by a stand 8 that is fixedly secured to a chassis (not shown) provided inside of the housing 26. The toner charge/supply unit 10 is disposed beneath the aperture electrode 1. The charge/supply unit 10 is constructed with a toner casing 15, a toner-bearing drum 11, a toner supply roller 12, and a toner regulating blade 13 for regulating the thickness of the toner layer deposited on the peripheral surface of the toner-bearing drum 11. Toner is stored in the toner casing 15. The toner supply roller 12 supplies tone particles to the peripheral surface of the toner-bearing drum 11. The toner supply roller 12 is rotated in the clockwise direction as indicated by an arrow so that the toner particles are fractionally charged to negative polarity. The toner regulating blade 13 is urged against the toner-bearing drum 11 to remove an excessive amount of toner on the toner-bearing drum 11 and to uniformly form a thin toner layer thereon.

The aperture electrode 1 is held by the stand 8 so that the center portion of the aperture electrode 1 including the apertures 4 is bent to generally follow the curved surface of the toner-bearing drum 11 and in surface contact therewith.

The back electrode 6 is disposed above the aperture electrode 1. A spacing of, for example, 1 mm, is formed between the back electrode 6 and the aperture electrode 1 to allow the recording medium P to pass therethrough. A voltage of 1 kV is applied to the back electrode 6 by a power source 7.

The recording medium P is inserted from the insertion opening 21 and transported below the back electrode 6 by a pair of guide rollers 23. After passing through the spacing between the back electrode 6 and the aperture electrode 1, the recording medium P is fed into a nip between a heat roller 24 and a press roller 25 so that toner on the recording medium P is thermally fixed. The heat roller 24 contains a heat source therein.

Operation of the recording apparatus thus constructed will be described while referring to FIGS. 1 and 2.

In the toner charge/supply unit 10, the toner 14 stored in the toner casing 15 is supplied to the toner bearing roller 11 in accordance with rotations of the toner supply roller 12. At this time, the toner particles 14 are negatively charged through frictional contact with the toner-bearing drum 11 and the supply roller 12. The negatively charged toner particles 14 are attracted onto the peripheral surface of the toner-bearing drum 11 and conveyed in accordance with rotations of the toner-bearing drum 11. The thickness of the toner layer is regulated by the toner regulating blade 13, and a toner layer of a uniform thickness is brought to the aperture portions of the aperture electrode 1 while being urged against the surface of the toner-bearing drum 11 by the aperture electrode 1.

In the contacting portion of the aperture electrode 1 and the toner-bearing drum 11, the force operating in the direction opposite the toner conveying direction is imparted on the upper portion of the toner layer held on the toner-bearing drum 11. The force results from the frictional force produced by the contact of the toner layer and the back surface of the aperture electrode 1. On the other hand, image force or Van der Waals force operating in the same direction as the toner conveying direction is imparted on the lower portion of the toner layer. These two oppositely operating forces act as a shearing force to the upper and lower toner layers. Under such a circumstance, the toner particles quiver in the contacting portion of the aperture electrode 1 and the toner-bearing drum 14. Initially, the upper layer toner particles start quivering and these quivering toner particles cause the lower layer toner particles to also quiver.

Through the quivering movements of the toner particles 14, they are free from the image force or Van der Waals force with the toner-bearing drum 11 and conveyed to the aperture portions of the aperture electrode 1. The passage of the toner particles through the apertures of the aperture electrode 1 is controlled depending on the voltage applied to the control electrode 3 from the control voltage applying circuit 5. Coulomb force generated by the electric field developed by the control electrode 3 is the major force applied to the toner particles staying in the aperture portion, because the toner particles introduced into the apertures 4 have been free from an attraction force of the toner-bearing drum 11. Therefore, a weak electric field suffices to pass a large amount of toner through the apertures 4, thereby increasing the recording density. Further, because a duration of time for applying the voltage to the control electrode can be shortened, the recording speed can be increased.

A frictional force generated by the aperture electrode 1 and the toner layer is proportional to a contacting pressure of the aperture electrode 1 against the toner layer. If there are scratches or wrinkles on the base film 2 of the aperture electrode 1 so as to protrude toward the toner-bearing drum 11, the contacting pressure in the scratched or wrinkled portion becomes locally high. If the contacting pressure becomes high, the shearing force imparted on the toner layer increases, so that the number of quivering toner particles increases and hence an increased amount of toner passes through the apertures 4 of the aperture electrode 1. This means that the scratched or wrinkled base film portions increase the recording density.

If the scratches or wrinkles on the base film 2 protrude upwardly, the contacting pressure of the aperture electrode 1 against the toner layer in these scratched or wrinkled portions becomes locally low. As a result, the shearing force imparted on the toner layer is not sufficient to relieve the toner layer of the attraction force of the toner-bearing drum 11. Therefore, little toner particles quiver. The Coulomb force generated by the electric field of the control electrode is not as strong as to pass the toner particles through the apertures 4.

As described, the scratches or wrinkles on the aperture electrode 1 will record the images unevenly. To eliminate the uneven density recordation, it is necessary to remedy the scratches and to remove the wrinkles. The present embodiment uses an electrically insulating film 2 of more than 512 $Kg/mm^2$ modulus of elasticity and 25 $\mu$m thickness. A product of the modulus of elasticity and the thickness to the third power is more than 0.008 kg·mm, therefore, scratches and wrinkles do not yield in the base plate. With such a base plate, unevenness in the recording density can be prevented.

Next, description will be made with respect to the behavior of the toner particles 14 introduced into the aperture 4 of the aperture electrode 1 and controlled by the electric field developed by the aperture electrode 1.

The negatively charged toner particle 14 introduced into the aperture 4 of the aperture electrode 1 is controlled by the voltage applied to the control electrode 3 from the control voltage applying circuit 5. More specifically, when 30 V is applied to the control electrode 3 based on image data, an electric field generated between the grounded toner-bearing drum 11 and the control electrode 3 extends into the inner space of the aperture 4, so that the negatively charged toner particles 14 are allowed to pass through the aperture 4. When minus 30 V is applied to the control electrode 3, an electric field generated between the grounded toner-bearing drum 11 and the control electrode 3 prevents the negatively charged toner particles from passing through the aperture 4.

An electric field is developed between the aperture electrode 1 and the back electrode 6 to which 1 KV is applied from the power source 7. The toner particles 4 having passed through the aperture 4 is attracted toward the back electrode 6 along the electric field developed therebetween. The toner particles are captured by the recording medium P fed into the spacing between the back electrode 6 and the aperture electrode 1. As the recording medium P moves, a two-dimensional toner image is formed thereon. The toner image carrying recording medium P is fed into the nip between the heat roller 24 and the pressure roller 25 to thermally fix the toner image. The image formed recording medium P is then discharged out of the discharge port 22.

Figure 3:
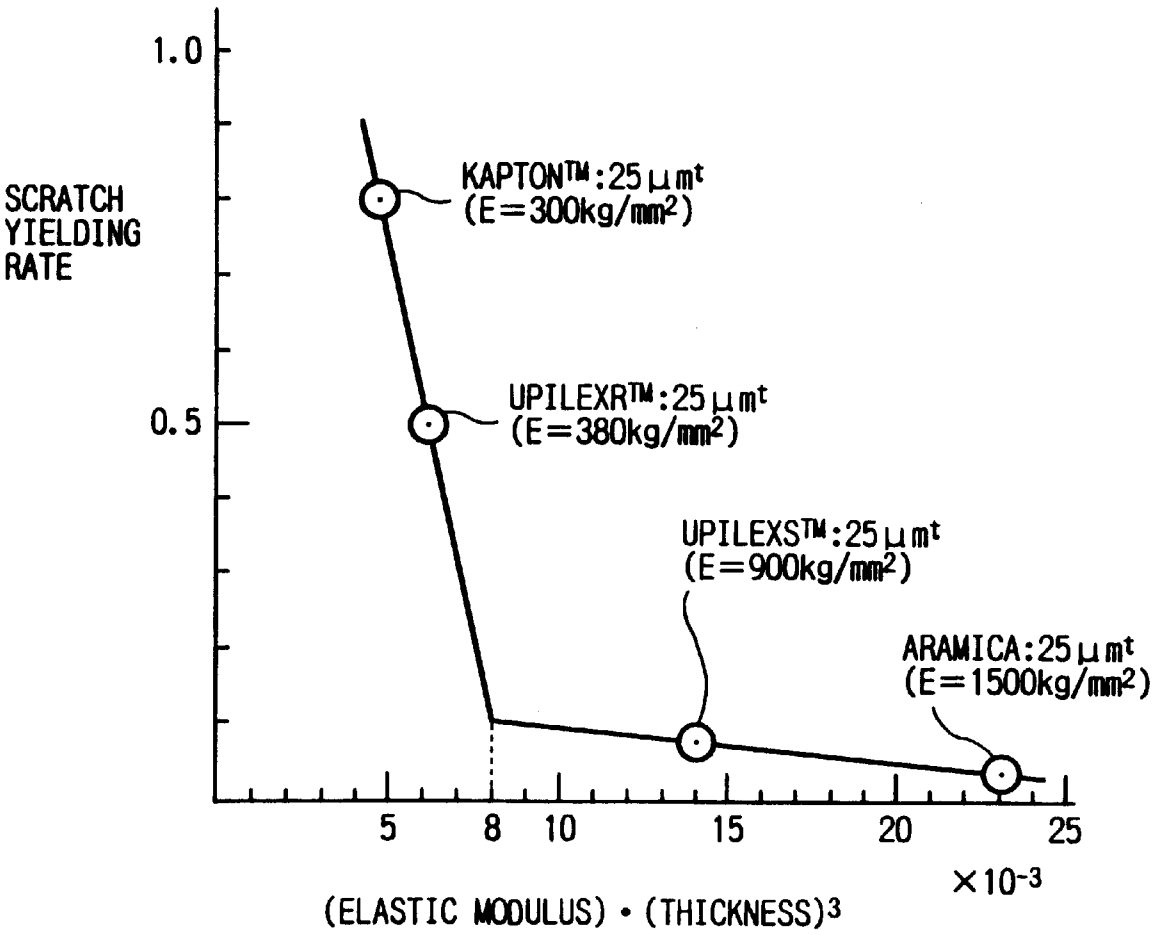
FIG. 3 is a graphical representation showing a relationship between elastic modulus and scratch yielding rate measured through experiments.

FIG. 3 shows a rate of scratches yielded after production of aperture electrodes in relation to a product of the modulus of elasticity of the base film and the thickness of the base film to the third power. It can be appreciated from the investigated results shown in FIG. 3 that almost no scratches yield in the base film if the product of the modulus of elasticity and the thickness to the third power is more than 0.008 kg·mm. Conventionally, polyimide film known as KAPTON™ produced by Du Pont Company, Ltd. has been used as the material for the base film. Because of low rigidity of this material, scratches yielded anywhere in the base film at the time of production and this was the cause of horizontal recording density unevenness. In the embodiment of the present invention, a polyimide film known as UPILEXS™ produced by Ube Industries, Ltd. is used which is 25 $\mu$m thickness and 900 $kg/m^2$ modulus of tensile elasticity (the product of the modulus of elasticity and the thickness to the third power being approximately 0.014 kg·mm). With the use of this material, scratches and wrinkles did not yield.

While only one exemplary embodiment of this invention has been described in detail, those skilled in the art will recognize that there are many possible modifications and variations which may be made in this exemplary embodiment while yet retaining many of the novel features and advantages of the invention.

Figure 4:
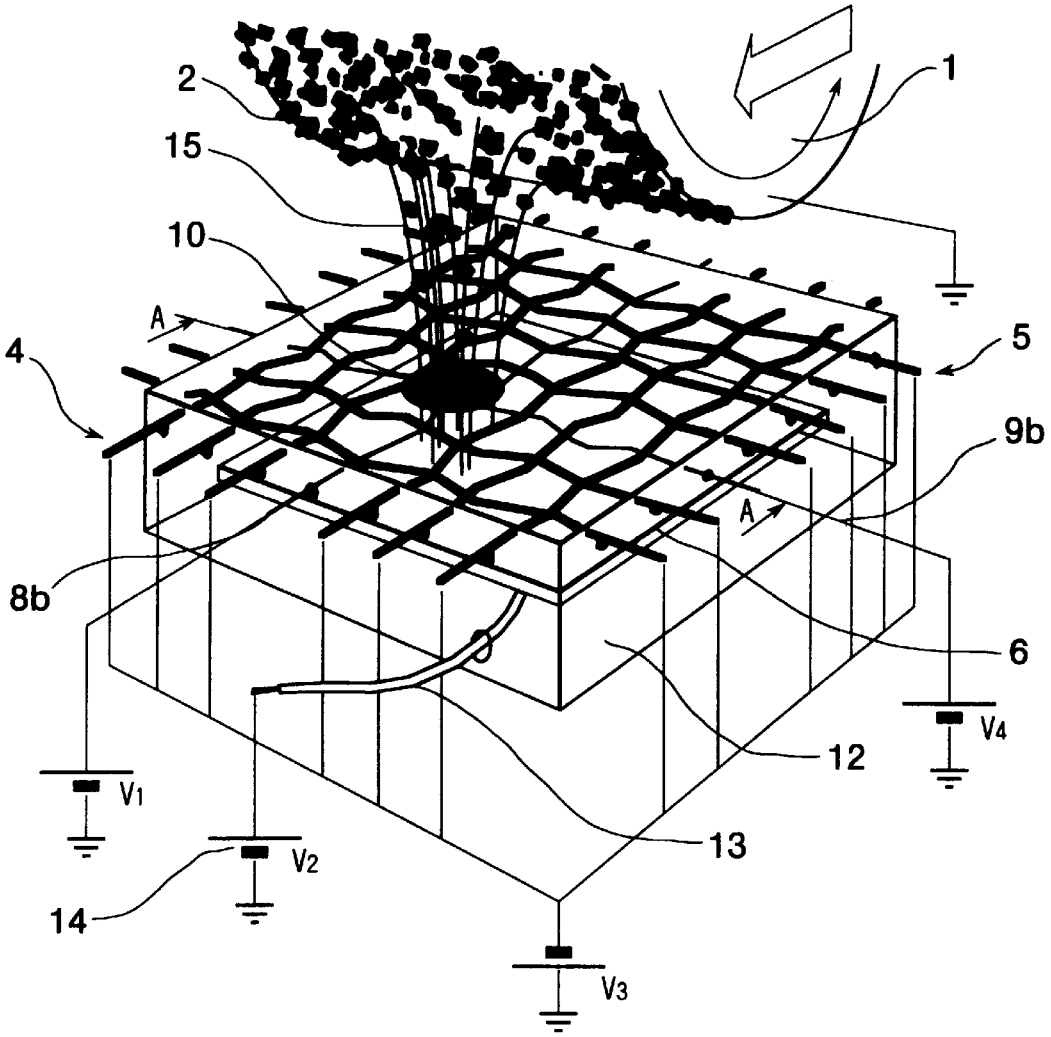
FIG. 4 (PRIOR ART)
FIG. 4 shows the prospective view of a prior art encased net-shaped electrode matrix with plate electrode and part of a developer.
Figure 5:
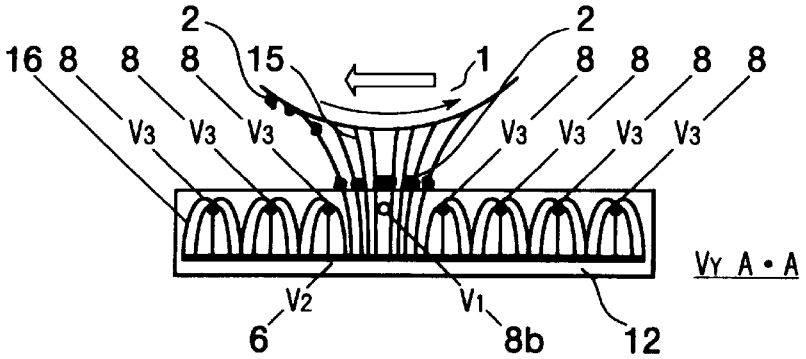
FIG. 5 (PRIOR ART)
FIG. 5 shows a section line 5—5 of the encased net-shaped electrode of electrode shown in FIG. 4
Figure 6:
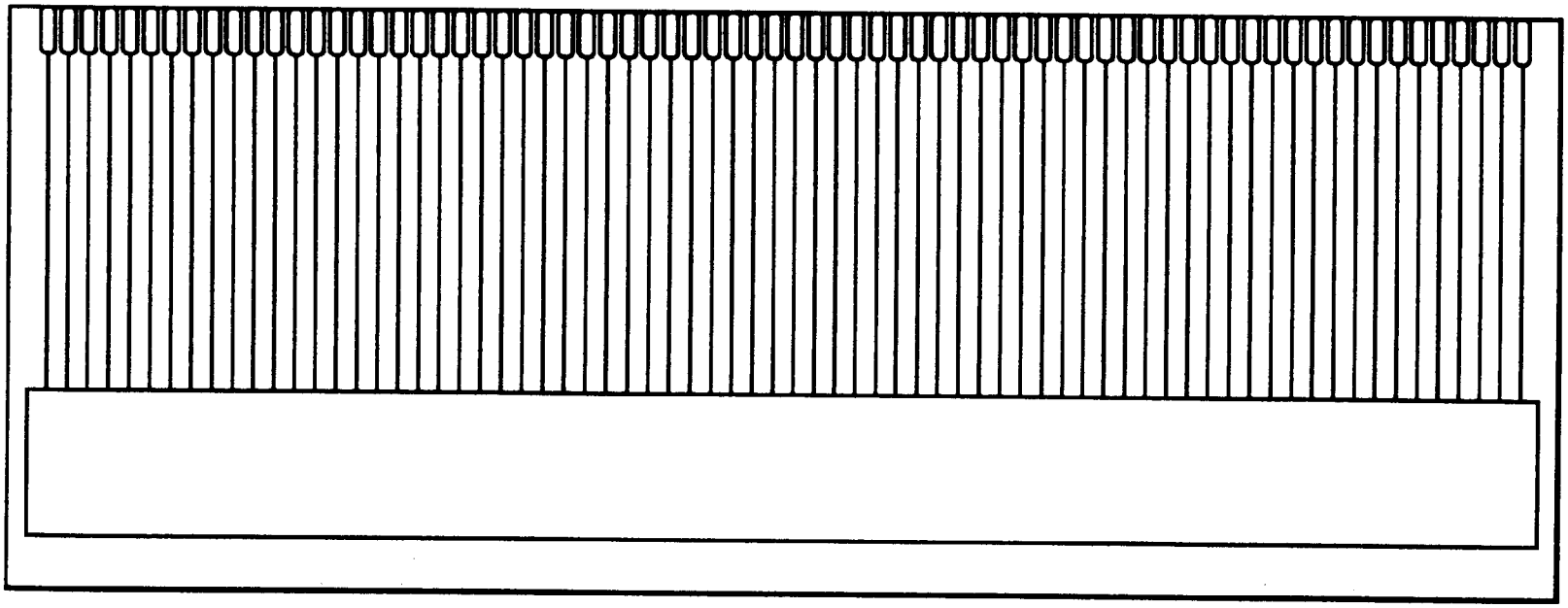

For example, a mesh-pattern recording electrode as depicted in FIGS. 4 and 5 of Japanese Laid-Open Patent Publication No. HEI-1-503221 or an edge electrode as disclosed in co-pending U.S. application Ser. No. 08/205,827 filed Mar. 4, 1994 by Masatake MAEDA can also be used as a recording electrode in lieu of the aperture electrode 1 used in the above-described embodiment.

What is claimed is:

1. A recording electrode, comprising:

a base film made from an electrically insulating material, and having a thickness t and a modulus of elasticity E;

at least one aperture formed in said base film;

a control electrode formed on an upper surface of said base film to surround said at least one aperture, said control electrode receiving a control voltage for selectively producing an electric field that attracts charged toner particles, wherein a product of $E \times t^3$ is more than 0.008 kg mm.

2. The recording electrode according to claim 1, wherein the product of $E \times t^3$ is approximately 0.014 kg mm.

3. The recording electrode according to claim 1, wherein the modulus of elasticity of said base film is more than 512 $kg/m^2$ and the thickness of the base film is 25 $\mu$m.

4. The recording electrode according to claim 3, wherein said control electrode is 8 $\mu$m thickness.

5. The recording electrode according to claim 3, wherein said base film is made from a high molecular resin.

6. The recording electrode according to claim 5, wherein said base film is made from polyimide.

7. The recording electrode according to claim 5, wherein said base film is made from aromatic polyamide.

8. A recording electrode, comprising:

a base film formed with a plurality of apertures, said base film being made from an electrically insulating material, and having a thickness t and a modulus of elasticity E; and a plurality of control electrodes formed on said base film, a control electrode surrounding each aperture of the plurality of apertures, said plurality of control electrodes controlling passage of charged toner particles through the plurality of apertures, wherein a product of $E \times t^3$ is more than 0.008 kg mm.

9. The recording electrode according to claim 8, wherein the product of $E \times t^3$ is approximately 0.014 kg mm.

10. The recording electrode according to claim 8, wherein the modulus of elasticity of said base film is more than 512 $kg/m^2$ and the thickness of the base film is 25 $\mu$m.

11. The recording electrode according to claim 10, wherein said control electrodes have a 8 $\mu$m thickness.

12. The recording electrode according to claim 10, wherein said base film is made from a high molecular resin.

13. The recording electrode according to claim 12, wherein said base film is made from polyimide.

14. The recording electrode according to claim 12, wherein said base film is made from aromatic polyamide.

15. A recording apparatus for recording images on a recording medium, comprising:

toner supplying means for supplying charged toner particles;

a back electrode;

a power source for applying a voltage to said back electrode to produce an electric field capable of attracting charged toner particles;

a recording electrode disposed between said toner supplying means and said back electrode and within the electric field produced by applying the voltage to said back electrode, said recording electrode having a control portion for selectively producing a second electric field that attracts the charged toner particles supplied by said toner supply means, thereby producing a flow of said charged toner particles from said toner supply means toward said back electrode, wherein said recording electrode comprises a base film made from an electrically insulating material, said base film having a thickness t and a modulus of elasticity E wherein a product of $E \times t^3$ is more than 0.008 kg·mm.

16. The recording apparatus according to claim 15, wherein said control portion of said recording electrode is a plurality of control electrodes formed on said base film to surround respective one of a plurality of apertures formed in said base film.

17. The recording apparatus according to claim 15, wherein said control portion of said recording electrode comprises mesh-pattern electrodes.

18. The recording apparatus according to claim 15, wherein said control portion of said recording electrode comprises edge electrodes having edge portions.

19. The recording apparatus according to claim 15, wherein said toner supply means comprises a drum rotatable about an axis of the drum and the drum having a peripheral surface for bearing the toner particles, and wherein said base film is formed with a plurality of apertures that are aligned in a direction in parallel to the axis of said drum.

* * * * *